United States Patent [19]

Burgdorf

[11] 4,042,169

[45] Aug. 16, 1977

[54] CONTAINER COVER

[75] Inventor: Joseph Louis Burgdorf, Rochester, Mich.

[73] Assignee: Corrugated Drum of Michigan, Inc., Pontiac, Mich.

[21] Appl. No.: 717,451

[22] Filed: Aug. 24, 1976

[51] Int. Cl.[2] ..... B65D 5/64; B65D 43/00

[52] U.S. Cl. ..... 229/43; 229/23 BT; 220/306

[58] Field of Search ..... 229/43, 23 BT; 220/90.2, 90.4, 90.6, 268, 269, 270, 306, 67

[56] References Cited

U.S. PATENT DOCUMENTS

| | | | |
|---|---|---|---|
| 1,918,987 | 7/1933 | Seabold, Sr. | 220/306 X |
| 2,984,382 | 5/1961 | Florsheim, Jr. | 220/306 |
| 3,110,436 | 11/1963 | Wagner | 229/43 |
| 3,111,240 | 11/1963 | Whitton, Jr. | 220/67 |
| 3,115,292 | 12/1963 | Repking | 229/23 BT X |
| 3,208,620 | 9/1965 | Herdering | 220/306 X |
| 3,355,061 | 11/1967 | Ritter | 220/306 |
| 3,904,074 | 9/1975 | Hoffman | 220/306 X |
| 3,986,659 | 10/1976 | Vajtay | 229/43 |

*Primary Examiner*—Davis T. Moorhead
*Attorney, Agent, or Firm*—McGlynn and Milton

[57] ABSTRACT

A container cover for use with a multi-sided container having flaps attached to the ends of at least some of the sides thereof along a fold line so that each flap is foldable against the side to which it is attached, the cover including a multi-sided planar member having an equal number of sides as the container and an area approximately equal to the transverse cross-sectional area of the container, a first skirt member extending generally laterally away from the planar member, a second skirt member extending from the planar member in the same direction as the first skirt member and being generally parallel to and coextensive with the first skirt member and spaced inwardly therefrom a distance approximately equal to the thickness of the container side and the flap and locking tabs on one of the skirt members extending toward the other of the skirt members whereby, when the cover is telescopically applied to the container, the flaps are folded against their respective sides and snugly received between the skirt members and the ends of the flaps are engaged by the locking tabs to lock the cover in place.

10 Claims, 5 Drawing Figures

CONTAINER COVER

FIELD OF THE INVENTION

This invention relates to a container cover for a container and is particularly suited for use with corrugated cardboard containers.

BACKGROUND OF THE INVENTION

Corrugated cardboard is a well-known inexpensive material for container construction. In many container applications, however, corrugated cardboard containers are not acceptable since they lack the required strength. Hence, more expensive materials, such as fiberboard and paperboard, have been employed. Containers of these materials are usually cylindrical drums.

In an effort to improve the strength characteristics of corrugated cardboard containers, multi-sided containers, that is, those including six or more sides, have been developed. A multi-sided container more closely approximates a cylindrical shape and, therefore, is structurally stronger than a square or rectangular corrugated cardboard container of the same capicity. In many cases the sides of such containers are sufficiently strong to replace hardboard or paperboard drums. However, difficulties have been encountered in closing the ends of the container. In other words, covers or other closure means used with multi-sided corrugated cardboard containers have either been so complicated as to be impractical or simply not strong enough.

The capability of corrugated cardboard containers to handle many of the situations which now call for fiberboard or paperboard drums not only offers the advantage of cost savings, but also solves a storage problem. Fiberboard or paperboard drums always take up the same amount of space even though they are empty and not in use. Since it is oftentimes necessary to keep a stock of containers on hand for periodic use in industrial situations, storage space must be set aside for these containers. Corrugated cardboard containers, on the other hand, may be stored in a flattened or knocked-down condition and assembled as called for. In other words, a user can keep a bundle of container blanks which may be formed into containers when needed. It should be apparent that a bundle of cardboard blanks take up less space than an equal number of drums. If the expanded use of corrugated cardboard is to be realized, however, an adequate cover must be available for closing the bottom of the container. The bottom cover is the most critical since it supports a large portion of the weight of the containers contents. In evaluating the adequacy of a cover, it should be kept in mind that the container assembly operation must not be difficult or excessively time-consuming in order to be practical.

PRIOR ART

As mentioned above, multi-sided corrugated cardboard containers are well-known as shown, for example, in the U.S. Pat. Nos. 2,517,552 and 3,559,871. It is noted that these two patents disclose closure devices which comprise integral flaps attached to the sides of the container. Such closure devices are generally acceptable for the top of the container and it is contemplated that these or similar closure devices may be used for the top of the container described in conjunction with the instant invention. However, special consideration must be given to the closure device for the botton of the container since it is the bottom cover which must support a large portion of the weight of the contents of the container particularly when the containeer is being moved about.

At present, the prior art does not suggest a simple and inexpensive container cover which is suitable for use with a multi-sided corrugated cardboard container having sufficient strength and sealing capabilities to permit the use of a corrugated cardboard container as a substitute for fiberboard or paperboard drums.

SUMMARY OF THE INVENTION

The instant invention provides a container cover for a container, preferably a multi-sided corrugated cardboard container, which has improved strength and sealing characteristics. The container cover is adapted for use with a multi-sided container which includes flaps attached to the ends of at least some of the sides of the container along a fold line so that each flap is foldable against the side to which it is attached. The cover includes a multi-sided planar member having an equal number of sides as the container and an area approximately equal to the transverse cross-sectional area of the container. The planar member includes a first skirt member extending generally laterally away from the planar member and a second skirt member extending from the planar member in the same direction as the first member and being generally parallel to and coextensive with the first skirt member and spaced inwardly therefrom a distance approximately equal to the sum of the thicknesses of the container side and the flap. In other words, since the flap is an extension of the side, the distance between the skirts is approximately equal to double the thicknesses of the side. One of the skirt members includes locking tabs extending toward the other of the skirt members. When the cover is telescopically applied to the end of the container, the flaps are forced to fold against their respective sides forming a double-folded portion which is snugly received between the skirt members. When the cover is in place, the locking tabs snap over the ends of the flaps thereby locking the cover in place.

The container cover of the above-described design is securely locked onto the container by means of the interaction between the locking tabs and the flaps on the container sides. The strength of the connection between the cover and the container is enhanced due to the snug fit of the folded flap between the skirt members which forces the folded flap to assume a position generally parallel to the side to which it is attached. The snug fit between the skirt members and the double-folded portion also assures tight sealing to prevent leakage from the container. The container cover is also of simple design, can be quickly and easily attached to the container, and is inexpensive to manufacture.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Referring more particularly to the drawings, a cover constructed in accordance with the instant invention is generally shown at 10. The cover 10 is shown connected to a multi-sided corrugated cardboard container generally indicated at 12.

Figure 5:
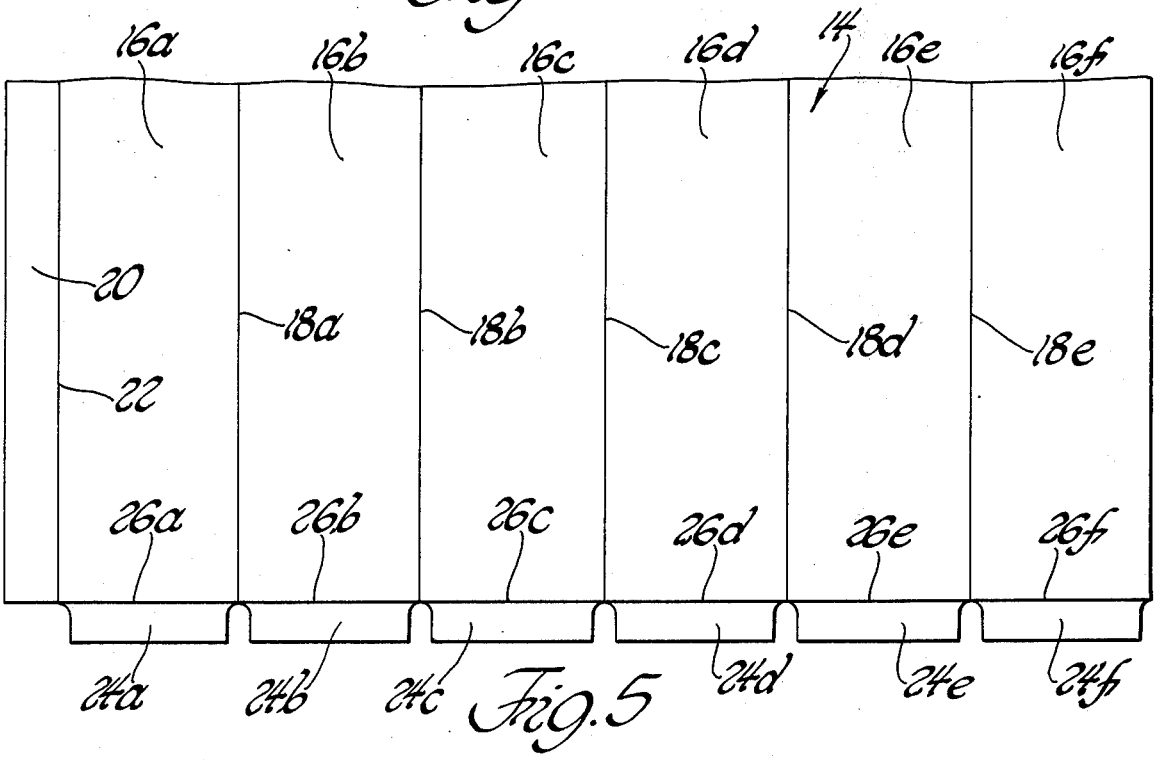
FIG. 5 is a plan view partially broken away of a corrugated cardboard blank suitable for use with the instant invention.

The multi-sided corrugated cardboard container 12 is preferably constructed from a cardboard blank generally indicated at 14 shown in FIG. 5. The upper portion of the cardboard blank 14 is not shown since it may include any suitable closure device, such as the integral flaps described in the patents noted above or it may be adapted to receive the cover of the instant invention, in which case the upper portion of the blank would be substantially identical to the lower portion shown.

The cardboard blank 14 includes six side panels 16*a* – *f,* adjacent ones of which are joined along fold lines 18*a* – *e.* A sealing flap 20 is joined to the farthest left-hand side panel 16*a* along a fold line 22. When the cardboard blank 14 is folded into a hexagonal shape, the sealing flap 20 overlaps the farthest right-hand side panel 16*f* and a suitable adhesive is employed to bond the two together.

The lower ends of the side panels 16i a – f are provided with flaps 24*a* – *f* which are attached to the side panels by fold lines 26*a* – *f.* The flaps 24*a* – *f* are generally rectangular and short in length. The side edges of each of the flaps 24*a* — *f* are relieved at their sides to permit uninhibited folding against the side panel to which it is attached.

The cardboard blank 14 may be made by conventional manufacturing techniques which need not be described here.

Figure 1:
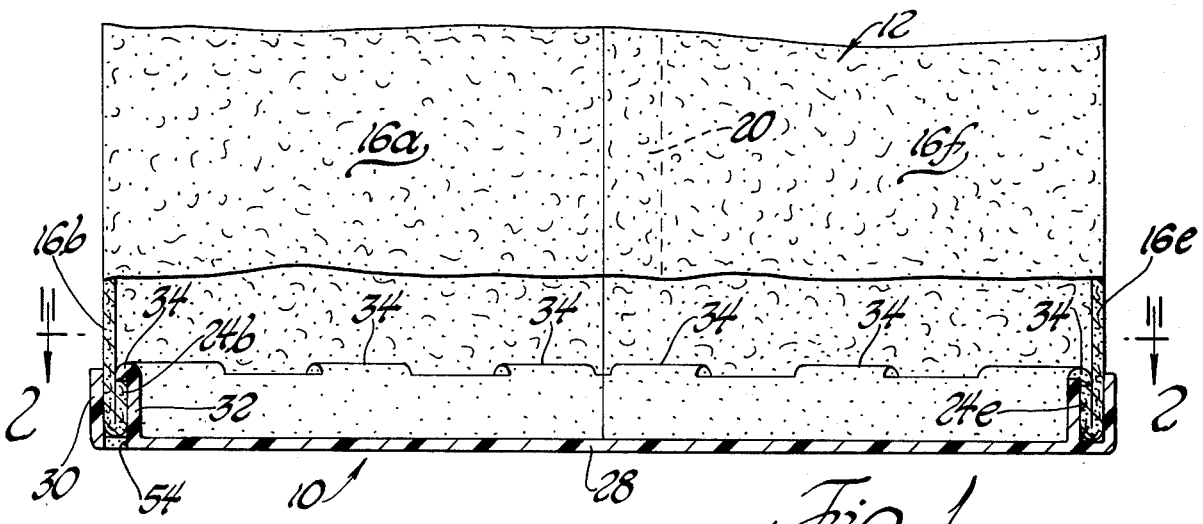
FIG. 1 is a broken-away elevational view partially in cross section of the lower end of a container and a container cover constructed in accordance with the instant invention.
Figure 2:
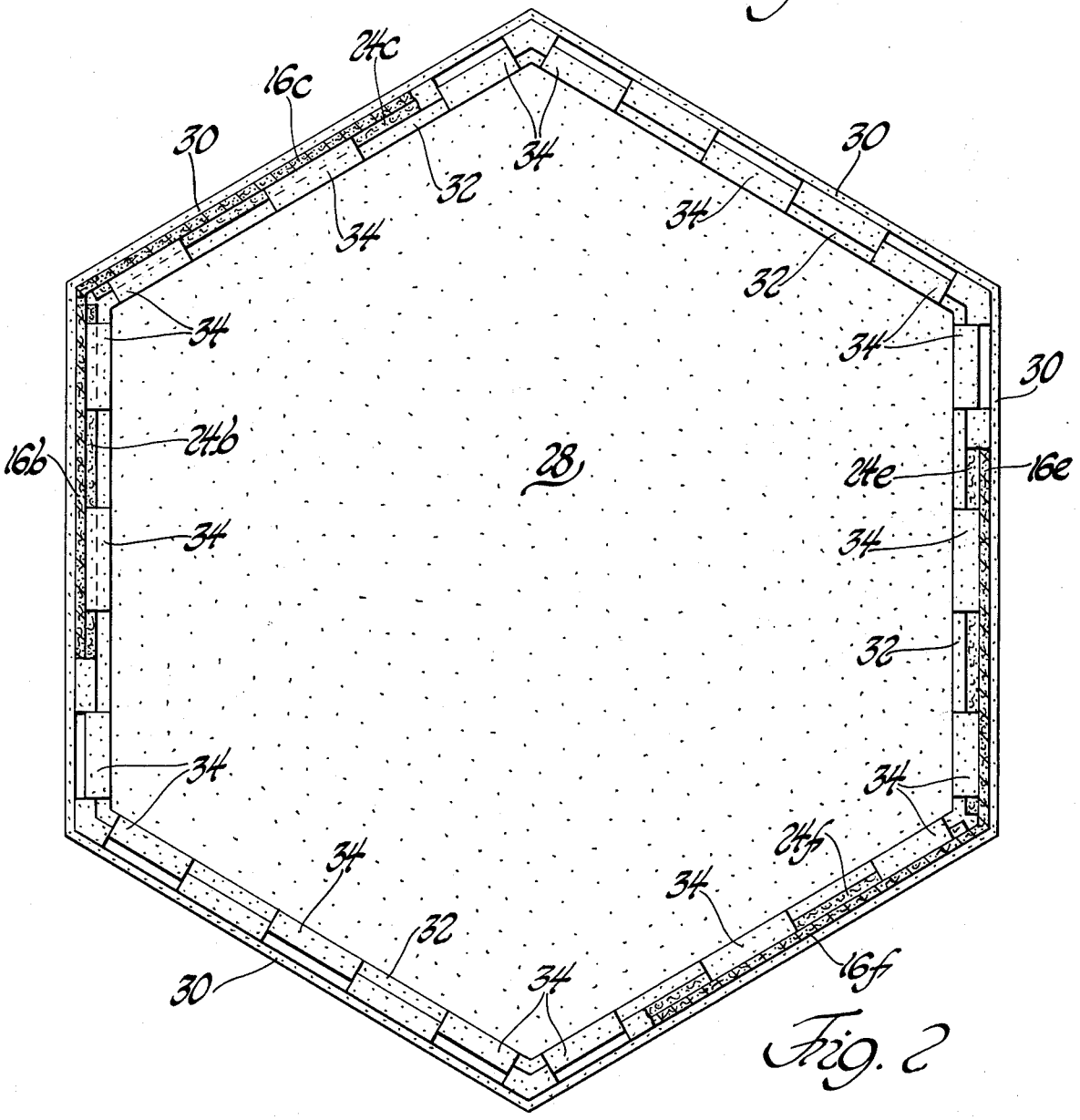
FIG. 2 is a view taken generally along line 2—2 of FIG. 1.

Referring to FIGS. 1 and 2, the container cover 10 includes a multi-sided planar member 28 which is adapted to cover the open end of the container 12. Hence, the planar member 28 is multi-sided and has an equal number of sides as the container 12, in this case six, and an area approximately equal to the transverse cross-sectional area of the container 12.

Integral with the planar member 28 is a first skirt member 30 which extends generally laterally away from the planar member 28. Preferably, the skirt member 30 is continuous, that is, the skirt member 30 is joined at the intersections betweeen the sides of the planar member 28.

The planar member 28 includes a second skirt member 32 which extends from the planar member 28 in the same direction as the first skirt member 30. The second skirt member 32 is generally parallel to and coextensive with the first skirt member 30. The second skirt member 32 is spaced inwardly from the first skirt member 30 a distance approximately equal to the thickness of the container side and the flap, for example, container side 16*b* and flap 24*b.* In other words, the distance between the two skirt members 30 and 32 is approximately equal to the thickness of the double-folded portion of the container material formed when the flap is folded against the side. This distance, however, is only an approximation. The function of the two skirt members is to snugly receive the double-folded portion. Hence, it may be desirable to slightly vary the distance between the skirt members to obtain the best results. It can be said that the optimum distance between the skirt members is fairly close to the thickness of the double-folded portion. Preferably, the second skirt member 32 is also continuous.

In the embodiment shown in FIGS. 1 and 2, the second skirt member 32 includes locking tabs 34 which extend toward the other skirt member 30. The locking tabs 34 are located on the skirt member 32 so that at least a portion thereof is located a distance away from the upper surface of the planar member 28 which is approximately equal to the length of the flaps 24*a* – *f.* As will be further described herein, this causes the locking tab 34 to engage the end of the flaps 24*a* – *f.*

The locking tabs 34, in contrast to the skirt members, are discontinuous. As shown, each of the six sides of the second skirt member 32 includes three locking tabs 34. It is necessary to provide discontinuous locking tabs since the locking tabs 34 must flex away from the first skirt member 30 to permit the flap members to pass beyond them. A continuous locking tab 34 might stiffen the structure to the point that it would not flex a sufficient amount to permit passage of the flaps. Additionally, and as will be more thoroughly described herein, since the container cover 10 is preferably made of a plastic material by an injection-molding process, mold design requires discontinuous locking tabs.

The container cover 10 is used in the following manner. After the blank 14 is folded into the hexagonal configuration and the sealing flap 20 is glued or otherwise secured to side panel 16*f,* the flaps 34*a* – *f* are folded slightly inwardly. The sides of the container cover 10 are then aligned with the sides of the open end of the container 12. The container cover 10 is applied by pushing the container cover 10 so that it telescopes onto the open end of the container 12. Initially, the locking tabs 34 engage the exposed sides of the flaps 24*a* – *f* and force them to fold against the sides of the container. As described above, the flaps are permitted to pass by the locking tabs since the locking tabs are capable of resiliently flexing inwardly, that is, in a direction away from the first skirt member 30. When the ends of the flaps have passed beyond the locking tabs 34, the locking tabs spring back into place, that is, into the positions shown in FIG. 1.

Due to the spacing of the skirt members 30 and 32 the double-folded portion is snugly, or tightly, held therebetween. The flaps 24*a* – *f,* of course, are forced to remain in a folded position against the side walls of the container 12. In other words, the flaps 24*a* – *f* remain substantially parallel to the side panels 16*a* – *f.* This orientation of the flaps 24*a* – *f* provides a structurally stable member for the locking tabs 34 to react against. The container cover 10 is thereby securely attached to the container 12.

Figure 3:
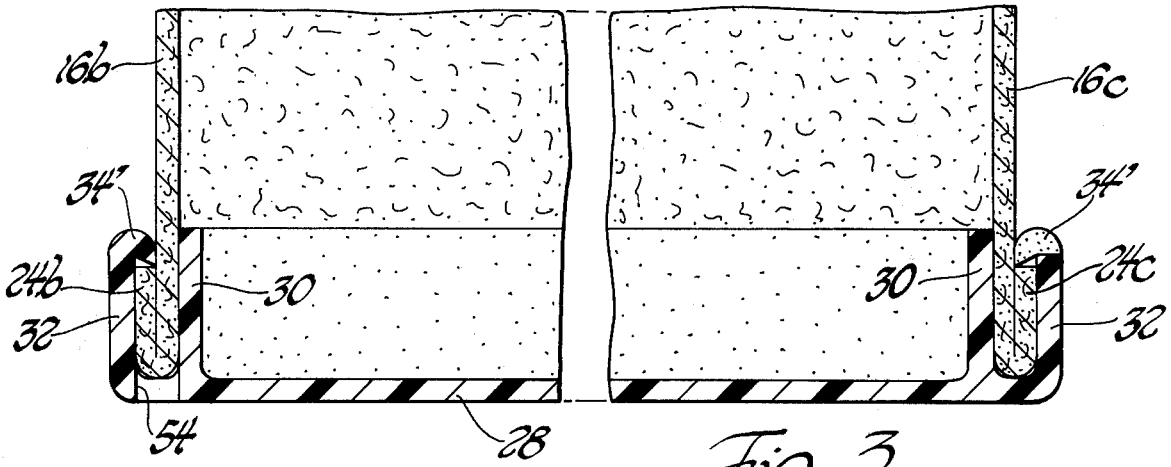
FIG. 3 is a cross-sectional view similar to FIG. 1 of an alternate embodiment of the instant invention.

While the above-described container cover is designed in such a manner that the flaps 24*a* – *f* are folded against the inside of the panels 16*a* – *f,* it is contemplated that the flaps may be folded against the outside of the side panels. An alternate embodiment of the instant invention employing this arrangement is shown in FIG. 3 wherein like numerals correspond to like or identical components. As shown in FIG. 3, the locking tabs 34' are located on the first or outer skirt member 30 rather than the second skirt member 32. The function of the cover is otherwise identical.

Figure 4:
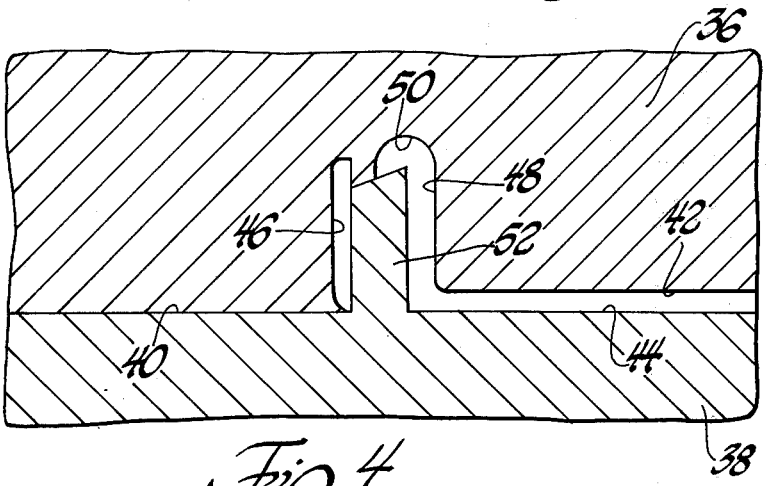
FIG. 4 is a broken-away cross-sectional elevational view of an injection mold suitable for manufacturing the container cover.

Preferably, the container cover 10 is made out of a plastic material of which there are many common and well-known types. The container cover is intended to be formed by means of an injection-molding process. A section of a suitable injection mold for forming the container cover 10 is shown in FIG. 4.

A significant factor to be considered in the manufacture of the cover is that the locking tabs 34 (or 34') produce an undercut which is difficult to form by an injection-molding process. The problem is solved by means of the injection mold shown in FIG. 4. More specifically, the injection mold includes first and second mold halves 36 and 38. The first and second mold halves are joined along a parting line 40 and include first and second spaced surfaces 42 and 44 for forming the planar member 28. The first mold section also includes surfaces 46 and 48 for forming the exterior surfaces of the outer and inner skirt members 30 and 32. In order to form a locking tab 34, surface 48 continues into an arcuate portion 50. The remaining surfaces of the skirt members 30 and 32 and the locking tab 34 are formed by a pin 52 which is integral with the second die section 38. In this manner, the required undercut is formed while permitting separation of the mold sections 36 and 38.

Due to the design of the mold sections 36 and 38 a rectangular opening 54 is formed in the planar member 28 below each locking tab 34 as shown in FIGS. 1 and 3. In order to insure that the openings 54 will not cause a leakage problem, the locking tabs 34 are spaced away from the corners of the skirt members 30 and 32. In other words, the locking tabs are not located at the intersections between the sides of the skirt members since the relieved portions of the flaps 24*a* – *f* are located at these intersections. At any other location the tight fit between the double-folded portion and the skirt members prevent leakage.

The container cover 10 herein described when attached to a corrugated cardboard container produces an exceptionally strong assembly which is capable of replacing more expensive fiber and paperboard drums in many heavy-duty applications. It should be apparent that space savings can be achieved since a bundle of cardboard blanks and a box of covers take up far less space than an equal number of drums. The ease with which the cover can be applied to the container should also be apparent.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

I claim:

1. In combination with a multi-sided container of corrugated material having foldable flaps attached to the ends of at least some of the sides thereof along a fold line, each of said flaps being foldable against the side to which it is attached, an injection molded plastic container cover comprising: a multi-sided planar member having an equal number of sides as the container and an area approximately equal to the transverse cross-sectional area of the container, a first continuous skirt member around the periphery of said planar member extending generally laterally away from said planar member, a second continuous skirt member extending from said planar member in the same direction as said first skirt member and being generally parallel to said first skirt member and spaced inwardly from said first skirt member a distance approximately equal to the sum of the thicknesses of the container side and the flap thereby forming a cavity therebetween which is substantially rectangular in cross section for capturing the container flap and a portion of the container side and locking tabs on one of said skirt members extending toward the other of said skirt members, said locking tabs being located on said skirt member a distance from the planar member which is no less than the length of said flap captured in said cavity and having at least a portion thereof positioned to engage the end of the flap whereby, when said cover is telescopically applied to the container, the flaps are forced against their respective sides and compressed between said skirt members and the ends of the flaps are engaged by said locking tabs to permanently lock said cover in place.

2. The container cover set forth in claim 1 wherein said skirt members are continuous.

3. The container cover set forth in claim 2 wherein said locking tabs are located on said second skirt member.

4. The container cover set forth in claim 2 wherein said locking tabs are discontinuous.

5. The container cover set forth in claim 4 wherein said locking tabs are spaced away from the corners of said skirt member.

6. In combination with a multi-sided container of corrugated material having foldable flaps attached to the ends of at least some of the sides thereof along a fold line, each of said flaps being foldable against the side to which it is attached, an injection molded plastic container cover comprising: a multi-sided planar member having an equal number of sides as the container and an area approximately equal to the transverse cross-sectional area of the container, a first continuous skirt member around the periphery of said planar member extending generally laterally away from said planar member, a second continuous skirt member extending from said planar member in the same direction as said first skirt member and being generally parallel to said first skirt member and spaced inwardly from said first skirt member a distance approximately equal to the sum of the thicknesses of the container side and the flap thereby forming a cavity therebetween which is substantially rectangular in cross section for capturing the container flap and a portion of the container side and locking tabs on one of said skirt members extending toward the other of said skirt members, said locking tabs being located on said skirt member a distance from the planar member which is no less than the length of said flap captured in said cavity and having at least a portion thereof positioned to engage the end of the flap and including an undersurface extending downwardly from its skirt member thus forming an undercut having an acute angle at the end of said locking tab whereby, when said cover is telescopically applied to the container, the flaps are forced against their respective sides and compressed between said skirt members and the ends of the flaps are engaged by said locking tabs to permanently lock said cover in place.

7. The combination set forth in claim 6 wherein said skirt members are continuous.

8. The combination set forth in claim 7 wherein said locking tabs are located on said second skirt member.

9. The combination set forth in claim 7 wherein said locking tabs are discontinuous.

10. The combination set forth in claim 9 wherein said locking tabs are spaced away from the corners of said skirt member.

* * * * *